US005680742A

United States Patent [19]

Hidding

[11] Patent Number: 5,680,742

[45] Date of Patent: Oct. 28, 1997

[54] METHOD AND APPARATUS FOR PREPARING POSTAL ITEMS

[75] Inventor: Gerhard Hidding, Heerenveen, Netherlands

[73] Assignee: Hadewe B.V., Netherlands

[21] Appl. No.: 684,793

[22] Filed: Jul. 22, 1996

[30] Foreign Application Priority Data

Jul. 21, 1995 [NL] Netherlands ..... 1000867

[51] Int. Cl.[6] ..... B65B 57/00; B65B 61/02; B65H 39/02

[52] U.S. Cl. ..... 53/411; 53/284.3; 53/460; 53/493

[58] Field of Search ..... 53/411, 460, 493, 53/494, 495, 53, 52, 51, 55, 54, 284.3, 131.2; 493/216

[56] References Cited

U.S. PATENT DOCUMENTS

| | | | |
|---|---|---|---|
| 4,338,768 | 7/1982 | Ballestrazzi et al. | 53/495 |
| 4,800,505 | 1/1989 | Axelrod et al. | 364/478 |
| 4,972,655 | 11/1990 | Ogawa | 53/155 |
| 5,067,088 | 11/1991 | Schneiderhan | 53/493 X |
| 5,099,633 | 3/1992 | Gombault et al. | 53/411 |
| 5,137,304 | 8/1992 | Silverschotz et al. | 53/411 X |
| 5,339,603 | 8/1994 | Gombault et al. | 53/429 |
| 5,445,367 | 8/1995 | Long | 53/411 X |
| 5,555,703 | 9/1996 | Gombault et al. | 53/411 |

FOREIGN PATENT DOCUMENTS 0 404 264 6/1990 European Pat. Off. .

*Primary Examiner*—James F. Coan
*Attorney, Agent, or Firm*—Burns, Doane, Swecker & Mathis, L.L.P.

[57] ABSTRACT

Documents are printed in accordance with sets of printing instructions. To a processing station, processing instructions are supplied, each associated with one of the sets of printing instructions. The order in which the processing instructions are executed corresponds with the order in which the sets of printing instructions are executed. Printed documents are supplied to the station, which processes the documents in accordance with the processing instructions whose turn is next. In order to check the processing of the documents, starting from one of the printing instructions, associated verification data are determined. The printing on the printed documents is scanned, whereby a scanning result is obtained. A scanning result is compared with verification data of which the associated sequence information corresponds with the sequence information assigned to that scanning result. If too large a difference is found, a difference report signal is generated. Also described is an apparatus for carrying out the method.

16 Claims, 3 Drawing Sheets

METHOD AND APPARATUS FOR PREPARING POSTAL ITEMS

BACKGROUND OF THE INVENTION

The invention relates to a method for preparing postal items, comprising: supplying to a printer a number of sets of printing instructions each intended for printing a document; the printing of documents by the printer in accordance with the supplied sets of printing instructions; supplying a number of mutually different processing instructions to a station of an apparatus for assembling postal items, which processing instructions are each associated with particular sets of the sets of printing instructions, while the order in which the processing instructions are carried out by the station corresponds with the order in which the sets of printing instructions are carried out by the printer; supplying documents from the printer to the station; operating the station in correspondence with the supply of a document to the station and with processing instructions associated with sequence information whose turn is next.

Such a method is known from European patent application 0404264.

In this known method, documents are printed and further processed in accordance with specific processing instructions associated with those printed documents, without the necessity of providing the documents with special indicia for controlling the further processing of those documents.

Because the printed documents are not scanned in order to read the associated processing instructions, however, the possibility exists that due to errors in the printing of the documents or in the transport of printed documents from the printer to the station, instead of an intended document, another document, which has been printed before or after the intended document and differs therefrom, is processed in accordance with the processing instructions associated with the intended document or in combination with other documents associated with the intended document. Such errors can occur, for instance, in that a document jams or in that a double sheet is supplied to the printer.

As a result of such errors, it is possible, for instance, that a set of personalized documents lacks a last document, which is then included in the next set, intended for a different addressee. It is also possible, for instance, that a bank statement is added to a letter which is addressed to a person other than the person to whose bank account the statement relates. It will be clear that these are extremely undesired consequences. In this connection, it is particularly disadvantageous that an error may have an effect on the assembly of subsequent postal items without this being noticed In particular if the documents are moreover printed batchwise and are transferred by hand as a stack from the printer to the mail assembling apparatus, the risk of incorrect processing due to irregularities in the transport is relatively great.

From U.S. Pat. No. 4,800,505 it is known to print documents batchwise and to provide them with special marks that represent codes associated with processing instructions that are stored in a memory. Each time a document is supplied to the mail assembling apparatus, the special marks of that document are read. In response to the code represented by the special mark as read the processing instructions corresponding with that code are read from the memory and the document is processed accordingly. Although the special marks are relatively small in comparison with special marks directly representing processing instructions, it is necessary, in determining the lay-out of the documents, to leave some space clear for the special marks, which requires additional coordination. A so-called bled-off printing is often impossible. Further such special marks disturb the appearance of documents and give the document an impersonal character.

According to U.S. Pat. No. 4,972,655, printed, continuous documents supplied from a hopper are separated from each other, marks are scanned from the documents (OMR), and the documents are further processed in accordance with those scanned marks as part of an item to mailed. If during the scanning no marks are found, a document is diverted to a bin for misprints. This method also has the inherent disadvantage that marks especially intended for the purpose of controlling the processing of the documents must be provided on the documents.

The object of the invention is to provide a method and an apparatus for preparing postal items with mutually different documents, whereby the documents are reliably processed in accordance with the corresponding processing instructions, without the necessity of providing the documents with special marks intended for the processing into postal items.

SUMMARY OF THE INVENTION

This object is achieved in accordance with the present invention in that a method as described above further comprises the steps of determining verification data, starting from the sets of printing in instructions; assigning to particular data of the verification data associated sequence information in accordance with the order in which the sets of printing instructions have been or are being executed by the printer; storing the verification data in a memory in combination with associated sequence information; scanning a printing of at least a number of the documents, whereby in each case a scanning result is obtained; assigning to scanning results associated sequence information in accordance with the order in which the documents have been scanned; comparing one of the scanning results with verification data of which the associated sequence information corresponds with the sequence information assigned to that scanning result; and generating a difference report signal if the scanning result shows more than a predetermined extent of difference from the verification data compared therewith.

Because for a particular document verification data are derived from the printing instructions for that document, it can be checked whether the correct printed document is being supplied by scanning that document and comparing the scanning result with the corresponding verification data. This means that it can be checked whether a station executes or will execute processing instructions corresponding with a particular document when that document reaches or will reach that station.

In response to the difference report signal, the apparatus can, for instance, switch to a stand-by condition. The assembly of postal items is then stopped as soon as a difference between the scanning result and the verification data greater than a preselected extent of difference has been found. Also, an alarm signal can be produced, while optionally it is indicated where the suspect document is located, and the intended printing of the expected document is shown on a display.

What can be prevented in any event is that an error in the supply of printed documents occurs without being noticed and that subsequently the documents are processed according to instructions associated with a preceding or a next document, without the necessity of providing special marks with a predetermined meaning on the document.

Because on the basis of sequence information assigned to each scanning result those verification data are selected whose sequence information corresponds with the sequence information that has been assigned to the scanning result to be compared, in each case only the verification data associated with one document need to be compared with the scanning result. So, it is known in advance with which verification data the scanning results are to be compared. As a result, in each case only one comparison is necessary, so that the comparison can be carried out relatively simply and in a short time. Accordingly, also more detailed verification data and scanning results with a high resolution can be compared with each other within the time available in practice. This is of advantage in particular if in succession different documents are printed and processed which show much similarity to each other and only differ from each other on a few points. Such a situation occurs, for instance, when printing standard letters merged with address lists and when mailing insurance policies and insurance offers, for which different sets of provisions are in force. By virtue of the invention the preparation and subsequent processing of such documents into postal items can be simply checked without the necessity of providing special marks intended for the further processing on the documents.

A further advantage of the method according to invention is that the operation of the printer can also be checked.

In the above-discussed known systems that work without reading special processing marks from the documents to be processed, the printed documents are directly processed, packaged and mailed, without the system operator having an opportunity to inspect these documents. This involves a good chance that malfunctions of the printer, as a result of which the intended printing, in whole or in part, is not printed or printed differently, go unnoticed.

In the method according to the invention, given suitably chosen verification data, a printing on a document that deviates from the intended printing leads to a difference report, so that the mailing of any document with printing errors can be reliably prevented.

The documents supplied to the printer can, for instance, be supplied as loose documents from a stack or in the form of mutually connected documents of a fanfold paper web. After the printing of the documents and prior to their being divided into sets, if applicable, they can optionally be stacked, whereafter the sets are formed by removing documents associated with a set in succession from a stack and incorporating a pause before documents of a next set are discharged. Another possibility is to form the sets by gathering documents coming from the printer into a stack, with a stack being discharged as soon as it constitutes a complete set of documents belonging together.

The check according to the invention can be carried out for all documents supplied from a printer, so that each document is checked. It is also possible, however, to carry out the scan and verification by spot checks. Because transport errors have a continued effect and the chance of two successive errors cancelling each other out is small, the risk that postal items obtain an incorrect composition without an error being reported is also very minor if the check is done through spot checks.

It is noted that wherever in the present application mention is made of documents, these documents obviously can each be part of a larger whole end, for instance, constitute an outer document of a signature or a stack. Further, the documents or a number of the documents can also be formed by envelopes (for instance stamped addressed envelopes) or be designed as labels on envelopes, boxes or other objects.

The invention can further be embodied in an apparatus for assembling postal items, comprising: a station for processing documents; a document supply track connected to the station for supplying documents to be processed to that station; a control system coupled to the station, which control system is arranged for transmitting new processing instructions to the station in accordance with the supply of successive documents to the station, in such a manner that documents supplied to the station are processed by the station in accordance with the associated processing instructions; means for synchronizing the supply of processing instructions to the station with the supply of documents to the station; means for recording sequence information associated with verification data; means for reading the recorded sequence information; a scanning unit for scanning the printing of supplied documents, which scanning unit is coupled to the control system; wherein the control system is arranged for processing signals received during the scanning into scanning results, for assigning sequence information to the scanning results, for selecting verification data associated with particular sequence information, for comparing particular scanning results of the scanning results and selected verification data of the verification data, and for generating a difference report signal depending on an observed extent of difference between the particular scanning results and the selected verification data. Such an apparatus is specifically suited for carrying out the method according to the invention.

Further elaborations and advantages of the invention are described in the following description and claims.

DETAILED DESCRIPTION

Figure 1:
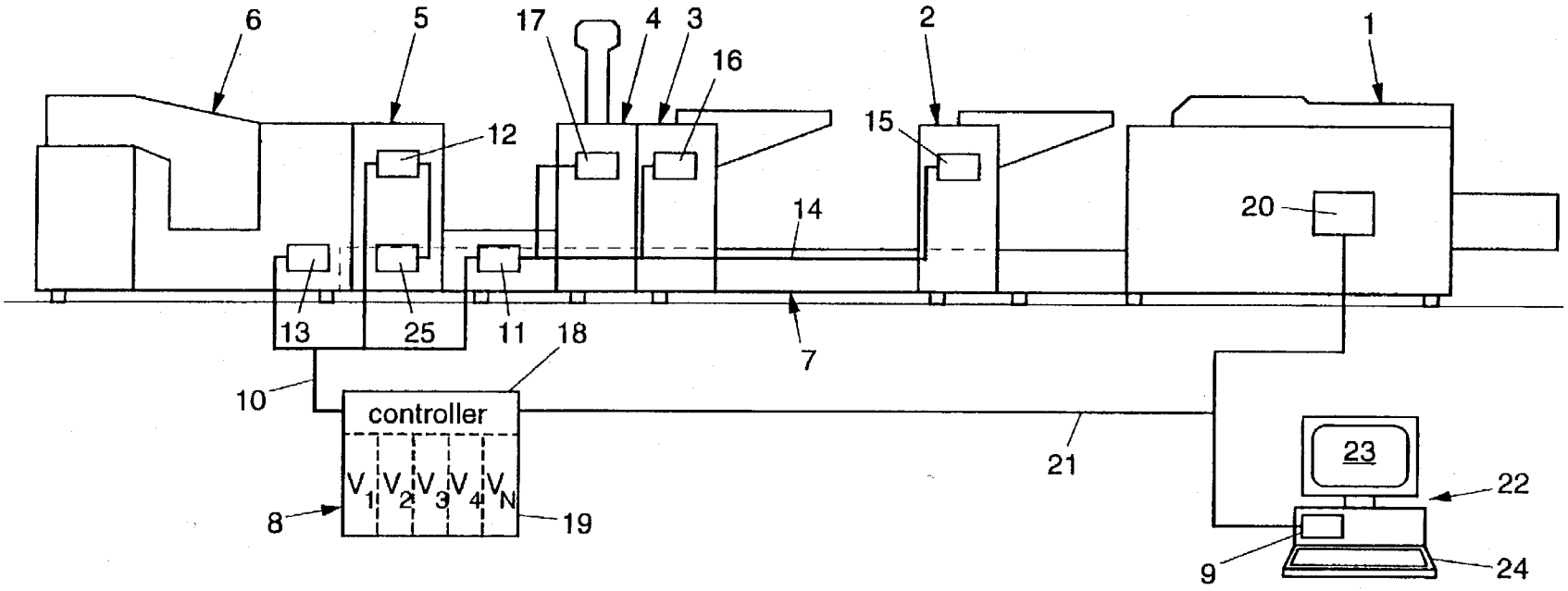
FIG. 1 is a diagrammatic representation of a first example of an apparatus according to the invention.

The invention is initially described with reference to the example of an apparatus according to the invention shown in FIG. 1 and the flow diagram of an example of a method according to the invention. These examples constitute the currently most preferred embodiments of the invention. In the drawing, corresponding parts of the different examples as shown are designated by identical reference numerals.

The apparatus for assembling items to be mailed shown in FIG. 1 is equipped with a number of stations 1–6, of which a first station is designed as a printer 1, a transport unit 7 which connects the printer 1 with the other stations 2–6 for supplying, one by one, individual documents printed by the printer 1 from the printer 1 to the other stations 2–6, and a control system formed by two processor systems 8, 9 for controlling the stations 1–6 and the transport unit 7.

More particularly, the stations of the apparatus according to this example are designed as: a printer 1, a first enclosure feeder 2, a second enclosure feeder 3, a folding station 4, a scanning unit 5 and an inserter station 6. The transport unit runs from the printer 1 along the first enclosure feeder 2, the second enclosure feeder 3 and the folding station 4 to the scanning unit 5. An example of an assembly with feeders 2, 3, a folding station 4 and a transport unit 7 as shown, is described in more detail in EP-A-0605066. The feeders 2, 3, the folding station and the inserter station 6 are intended for processing documents which are supplied by the transport unit 7 from the printer 1. For the purpose of collecting finished postal items, for instance a collecting container or bin or a discharge track leading to a sorting unit can be arranged downstream of the inserter station. Such discharge means are known per se and therefore not described further here.

For controlling the stations 2–6 downstream of the printer 1, one of the processor systems 8 is coupled via a bus system 10 with a processor 11 of the transport track 7, a processor 12 of the scanning unit 5 and a processor 13 of the inserter station 6. The processor 11 of the transport system 7 in turn is connected via a bus system 14 with processors 15, 16 of the first and the second enclosure feeder 2, 3 and with a processor 17 of the folding station 4. The processor system 8 for controlling the processing stations 2–6 and the transport unit is made up of a controller 18 and a RAM memory 19 with a number of memory locations $V_1$–$V_N$. Although the processor system 8 is depicted outside of the housings of the stations 2–6 and the transport track 7, it is preferably incorporated into the housing of the inserter station 6.

The printer 1 is provided with a processor 20. This processor 20 and the processor 8 of the control system are connected via a further bus system 21 with the other processor 9 which is part of a commercially available personal computer 22 with a display 23 and a keyboard 24.

The processor system 8 or controlling the stations 2–6 downstream of the printer 1 is arranged for transmitting new processing instructions to the stations in accordance with the supply of successive documents to the stations 2–6, in such a manner that documents which have been supplied to the stations 2–6 are processed by those stations 2–6 in accordance with the processing instructions associated with those documents, for instance in that the enclosure feeders 2, 3 selectively add enclosures or do not, the folding station 4 selectively folds documents in a particular manner or does not, and/or the sets of documents formed are selectively packaged in envelopes of different types or sizes.

The process system 8 for controlling the stations 2–6 downstream of the printer is further arranged for synchronizing the supply of processing instructions to the stations 2–6 with the supply of documents to those stations. According to the present example, this is done through communication with the stations. In each case, new instructions are transmitted to each of the stations 2–6 after a 'ready' report signal has been received from the station in question. However, other ways of synchronization are also possible, such as the transmission of synchronization pulses which indicate the beginning of a next working stroke for all stations.

In the personal computer 22 printing instruction sets for printing documents can be stored in combination with processing instructions associated with those printing instruction sets, and verification data generated starting from the printing instruction sets. The processing instructions and the verification data can be generated with the aid of this personal computer 22 or be loaded into this computer 22 from a data carrier or via an external communication channel. In order that, if desired, the printing instruction sets can be processed into verification data with this personal computer 22, the personal computer 22 contains a program suitable for that purpose.

In the memory locations $V_1$–$V_N$ the verification data associated with documents printed or to be printed by the printer 1 can be stored. By storing the verification data in the memory locations $V_1$–$V_N$ in a predetermined order, the memory locations $V_1$–$V_N$ also serve for recording sequence information associated with the stored verification data. The verification data associated with the n-th document can, for instance, be stored in memory location $V_N$.

The controller 18 can read what verification data are stored in a particular memory location V of the RAM 19 and is therefore also arranged for reading the sequence information, since this sequence information has been recorded by storing the verification data associated with successive printing instruction sets, that is, documents, in successive memory locations in accordance with the sequence.

The processor system 8 for controlling the stations 2–6 downstream of the printer 1 is further arranged for processing signals which are received from the processor 12 of the scanning unit 5 during the scanning of passing documents by a reading head assembly 25 of the scanning unit 5. Further, this processor system 8 is arranged for assigning sequence information to the thus obtained scanning results and for selecting verification data associated with particular sequence information which is represented by the number or address of the memory location V where the verification data are stored.

In addition, the processor system 8 for controlling the stations 2–6 downstream of the printer 1 is arranged for comparing the scanning results obtained starting from the received signals, with the selected verification data, and for generating a difference report signal when an extent of difference between the scanning results and the selected verification data has been found which exceeds a predetermined maximum extent of difference.

Figure 3:
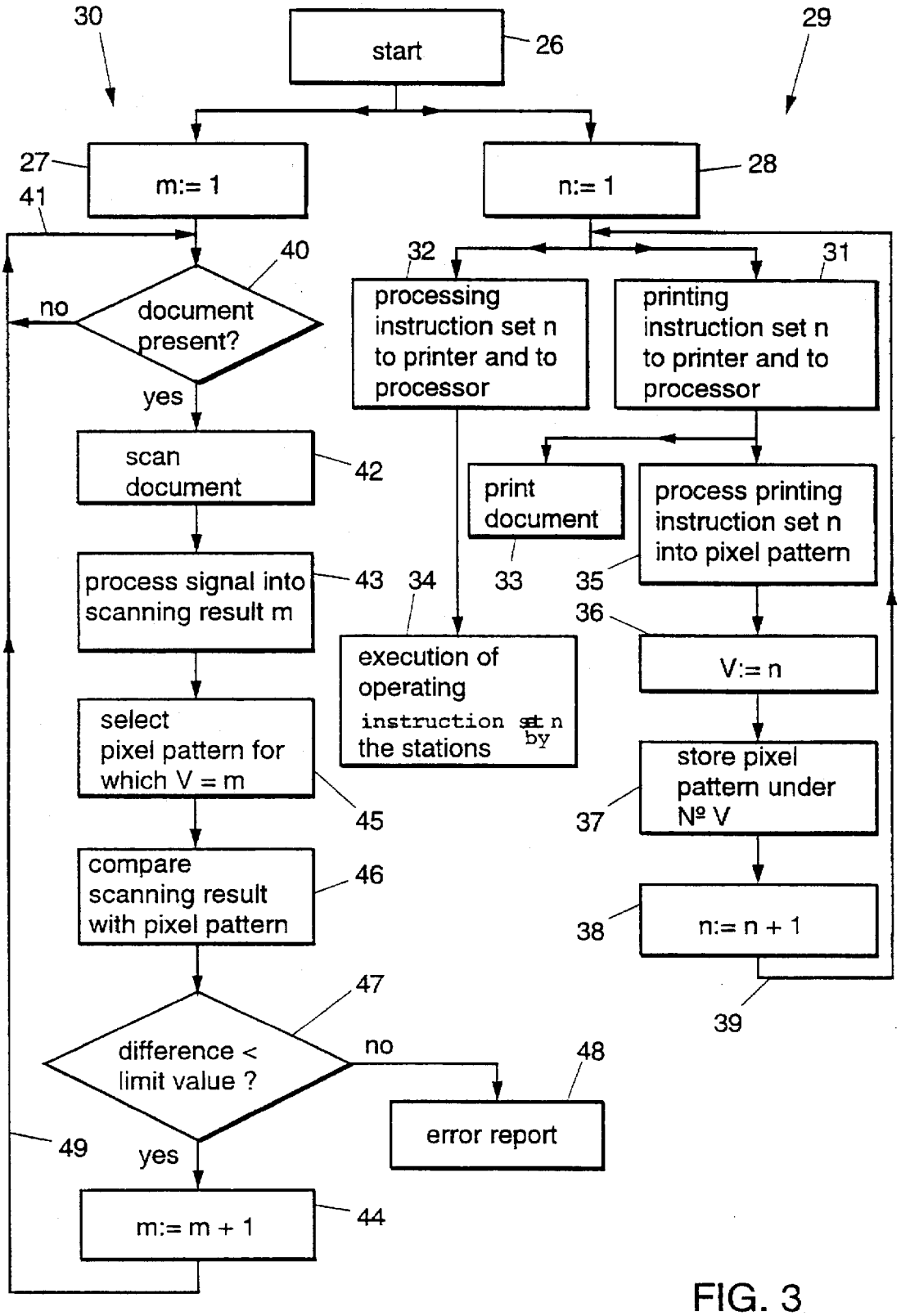
FIG. 3 is a flow diagram of an example of a method according to the invention.

Below, the operation of the apparatus according to the example shown in FIG. 1 is described and elucidated with reference to the flow diagram represented in FIG. 3.

After a start instruction 26, the counters m and n are initialized to the value 1, as represented with steps 27 and 28. The counters m and n are associated with two basic cycles 30 and 29, respectively, which are to be carried out more or less independently of each other. One cycle 29 concerns the actual production cycle in the form of the printing and processing of documents as well as the generation of verification data with associated sequence information in accordance with the printing instruction sets transmitted to the printer. The other cycle 30 constitutes a check or verification cycle during which data scanned from the documents are compared with the verification data which, according to the sequence information, are associated with the scanned data.

The production cycle 29 starts with the actions 31 and 32, the one action 31 consisting in supplying, from a memory of the personal computer 22, a set of printing instructions n for printing a document to the printer 1 and to the processor 9 of the personal computer 22, and the other action 32 consisting in transmitting the processing instructions n associated with the printing instructions n to the controller 18.

For the processor 9 of the personal computer 22, the next action 35 is processing the printing instruction set n into a representation of a pixel pattern of the document printed or to be printed, or a part thereof.

The next action 36 consists in assigning the instantaneous value of the counter n to the sequence code V.

Then the pixel pattern is stored in a memory location with address V, as is represented by action 37.

Finally, the determination of the verification data is ended with the increase of the counter n, as represented by action 38. For a next document the cycle is repeated with the increased counter n, as appears from the return loop 39. If the number of available memory locations (N) is less than the number of documents to be processed, the action 39 preferably provides further that each time the counter n has reached the value N, the value 1 is assigned to it again for the next cycle. New pixel patterns can without objection be written over the oldest pixel patterns still present in the memory locations, for the documents corresponding with those old pixel patterns have been processed by then.

Instead of storing the verification data under addresses corresponding with the order of receipt of the verification data, it is also possible to store the verification data under random addresses in association with a sequence code, such as the code V according to the present example.

The physical processing of the instructions consists in the printing of documents and the processing of the documents by the stations 2–6 located downstream of the printer 1.

In accordance with the set of printing instructions n supplied to the printer 1, the printer 1 prints a document of one or more pages and each printed sheet of the document is fed to the transport track 7. These operations are designated with reference numeral 33. If the document consists of several sheets, these can, for instance, be gathered upon being delivered to the transport track 7 and/or downstream of the folding station 4.

The document delivered by the printer 1 is passed along the transport track 7 successively to the consecutive stations 2–6 located downstream of the printer 1. The processor system 8 which is connected to the bus system 10 ensures that in accordance with the order in which the printed document reaches the stations 2–6 located downstream of the printer 1, timely before the arrival of the document, those processing instructions of the processing instructions associated with the document that are intended for the relevant station 2–6 are supplied to the stations 2–6. Thus, in principle, the processing stations 2–6 operate, upon the arrival of printed documents at those stations 2–6, in accordance with the set of processing instructions associated with those documents. For the sake of convenience, this processing of the processing instructions n, which consists of several steps and is known per se, has been designated as a single group of operations 34.

For that matter, it is also possible that one or more of the processing stations 2–6 always carry out the same operation. In that case, those stations obviously need not communicate with the controller 18.

Because the execution of the processing instructions is automatically deferred until a document arrives, the program of the controller need not contain any special testing actions to defer the execution of the processing instructions until the action 33 of printing and delivering the document in question has been completed.

The verification cycle 30 during which the printed document is checked starts with a testing action 40 consisting in determining whether a document is present at the reading head assembly 25 of the scanning unit 5. The action 40 is repeated as long as the condition of the presence of a document has not been fulfilled. This has been indicated with a loop 41. The frequency with which it is determined whether the condition of the presence of a document is satisfied can be chosen depending on the design of the scanning unit and the intended processing capacity.

The next action 42 of the verification cycle 30 constitutes the actual start of the check of the document and consists in scanning the printing of the document by scanning the passing document with the aid of the reading head assembly 25 of the scanning unit 5.

During scanning a signal is obtained, which is thereupon processed into a scanning result, as has been indicated by action 43. The signal can be delivered by the scanning unit in a form which allows direct comparison with the pixel pattern of the verification data. In that case, the action 43 of processing into a scanning result is preferably limited to storing the received signal in a buffer memory. Also, to the scanning result there is automatically assigned associated sequence information in the form of the position of the counter m during the cycle in which that scanning result is obtained and is used for checking the scanned document. Owing to the fact that the counter m is increased (action 44) at the end of each verification cycle, and if necessary is set to 1 again after a number of cycles, the value of the counter m is always in agreement with the sequence in which the documents have been scanned and in which the scanning results have been obtained.

Then follows the selection of the pixel pattern whose associated sequence information—in this example the address of the memory location V where the pattern is stored—corresponds with the sequence information assigned to the scanning result—in this case the instantaneous value of the counter m. This step is represented by action 45.

Now it has been determined what pixel pattern should agree with the scanning result if the printing of the document and the transport to the scanning unit 5 has proceeded in the intended manner. The actual comparison between the obtained scanning result and the selected pixel pattern is represented as step 46. The outcome of this comparison is a difference which, in principle, can also be zero.

The next action 47 concerns the check of whether this difference is allowable or should at the least be considered suspect. In this example it is determined whether the number of pixels of the scanning result that differ from corresponding pixels of the pixel pattern is greater or less than a specified limit value. This limit value can be adjustable in order to enable the user to set it in accordance with the documents to be processed. If for each pixel one of 32 grey values applies, a difference can be assumed, for instance, when the brightness of a pixel of the scanning result differs by at least two grey values of the corresponding pixel of the pixel pattern of the verification data. Naturally, any differences found between corresponding pixels of the scanning result and the verification data can also be weighted depending on the magnitude of the differences found. Further, in order to obtain an automatic calibration of the system, the interpretation of the signal received from the scanning unit 5 or the processing by the scanning unit 5 itself can be continually adjusted on the basis of trends in deviations between the scanning result and the verification data within the limits of the accepted deviations.

If the outcome of the checking action 47 is that the difference which has been established is greater than the difference that is considered allowable, a difference report signal is generated, as has been indicated by action 48. Preferably, in reaction to a difference report signal, the entire apparatus is automatically stopped in order to afford an operator an opportunity to determine what the cause of the difference report is.

If it appears from the checking action 47 that the scanning result shows less than a predetermined amount of difference from the verification data compared, the verification cycle proceeds with the above-mentioned action 44 of increasing or re-setting the counter m, whereupon a next cycle 30—that is, the check of a next document—can ensue, as has been indicated with a return loop 49.

If meanwhile a next document has arrived at the location of the scanning unit 5, scanning can be commenced immediately. In order not to slow the processing of documents, however, the verification cycle preferably proceeds faster than the production cycle 29, so that always some time elapses before, upon completion of a verification cycle, the checking action 40 yields the outcome "yes". Optionally, it is also possible to allow documents that arrive during the check of a preceding document to pass without being checked. Owing to the circumstance that any printing and transport errors also affect the composition of subsequent postal items, any first errors that were missed are still detected later on. It is important here that the unchecked passage of documents is recorded in order that the counter m can be given the correct value during a next verification cycle.

When upon comparison of a scanning result with verification data a difference greater than the predetermined maximum amount of difference has been found, the generation of a difference report signal can be deferred until a number of next documents have been scanned and checked. If it appears, for instance, that scanning results of a preceding and of a next document show sufficient agreement with the relevant verification data, this is an indication that probably no transport failure has occurred and that the cause of the difference report signal was probably that something was wrong with the document in question or the set in question, or that the cause was the occurrence of a malfunction, for instance due to an interference signal.

It is therefore preferred that if it has been found that as regards a number of preceding and following documents or sets, a sufficient agreement between the scanning result and the corresponding verification data is present, a special difference report signal is generated. In response to this special difference report signal, the suspect document or the suspect set can be diverted via a reject outlet, whereafter it can be inspected by operator of the apparatus, while the apparatus otherwise remains in operation without interruption. If no reject outlet is present, the signal can be given to the operator for him to inspect the document in question or the set in question. If the documents to be mailed are not very important, it is also possible in response to the special difference report signal simply to continue operation without any interruption.

Further, after upon the comparison of a scanning result with verification data a difference greater than the predetermined maximum extent of difference has been established, it can also be determined first whether there is a sufficient agreement between the scanning result and following or preceding verification data and/or between the verification data and following or preceding scanning results.

If, for instance, it is established that there exists sufficient agreement between the scanning result and the first next verification data, then this is an indication that the expected document is lacking or has ended up in a preceding or following set. After inspection has revealed what the nature of the malfunction is, the given that there is sufficient agreement between the scanning result and the first next verification data can be used as a basis for the renewed synchronization of the process.

The comparison of scanning results and verification data can be carried out in different ways and at different levels. Instead of reducing both scanning signals and printing instructions to pixel representations as described hereinbefore, it is also possible, for instance, to store the verification data in the form of coded representations of successions of alphanumeric characters in accordance with at least a part of the sets of printing instructions, for instance in the form of files that contain text or parts thereof on the basis of which the printing instructions are generated. During the processing of scanned patterns, characters in the scanned printing patterns are identified. Successions of the identified characters are finally compared with the successions of characters as represented by the verification data which according to the associated sequence information correspond with the scanning result. Scanners and software for character recognition are commercially available.

Another possibility for comparing scanning results and verification data, which is simple especially as regards scanning but effective in many cases, can be used if the printing of at least some of the documents consists in the printing of at least a number of lines or columns.

According to this further example, when determining the verification data, it is derived from one of the sets of printing instructions how large the number of lines or columns is that intersect a particular path extending over the document. The scanning assembly 25 is positioned in transverse direction with respect to the transport track of the document, such that scanning is performed along that particular path. The signals from the scan are processed into a scanning result which indicates the number of lines or columns in the area of the scanning path. This can be simply carried out by counting the number of dips in brightness under a particular limit value. The comparison of the verification data and the scanning result can simply be carried out by comparing the number of lines according to a scanning result with the number of lines according to the verification data.

In order that during the scan the number of lines or columns can be reliably determined, during the scan of the documents the mean local printing density over an interval of a length of at least a half x-height and at least one and a half x-width of text on the document is registered. Thus lines or columns can be reliably detected without the number of counted lines or columns being influenced by differences between individual characters in portions of the different lines intersected by the scanning path.

Figure 2:
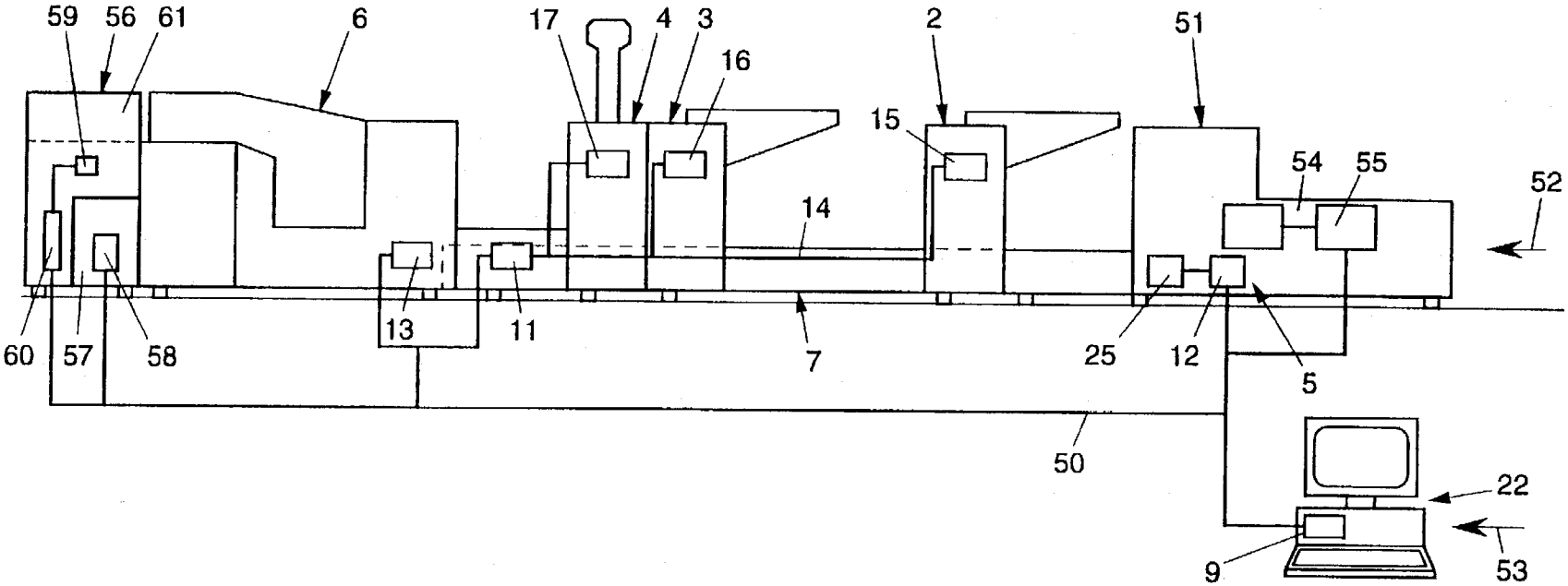
FIG. 2 is a diagrammatic representation of a second example of an apparatus according to the invention.

In the apparatus according to FIG. 1, the control system is formed by two communicating data processor systems 8 and 9. In FIG. 2 an alternative embodiment of an apparatus according to the invention is represented, with the personal computer 22 forming the central processor for controlling the apparatus. To that end, the processor system 9 of the personal computer 22 communicates via a bus system 50 with processors 11 and 13 of the transport track 7 and the inserter station 6, respectively. The communication between the processor 11 of the transport track 7 and the processors 15–17 of the stations 2–4 along the transport track proceeds, in this example as well as the example shown in FIG. 1, via a second bus system 14. For that matter, in both examples, instead of bus systems, other communication networks, such as systems of point-to-point connections can be used.

Further, the apparatus according to the example shown in FIG. 2 is not provided with a printer but with a supply station 51, into which documents printed elsewhere can be loaded, as diagrammatically indicated with an arrow 52. An arrow 53 represents the batchwise supply of processing instructions to the personal computer 22. The apparatus according to this example is thus intended for applications where the printing of batches of documents (action 33 in FIG. 3) and the generation of the verification data (cycle 29 in FIG. 3) is carried out elsewhere, before the processing of the batch of printed documents into postal items occurs. The processing instructions and the verification data can be supplied to the personal computer in different ways, known per se, both via data connections and by reading data from a data carrier. As already described hereinbefore, it is also possible to use the printing instructions themselves or data on which they are based, as verification data. Further it is also possible to supply these data to the personal computer 22 and thereafter to process then into verification data. Generating the documents then does not involve an additional operation for generating verification data. The actions pertaining to the processing of the documents are thus concentrated in one place.

The supply unit 51 is provided with a separation unit 54 for taking documents off a stack one by one. The separation unit 54 is preferably arranged for taking documents off the top of a stack, but may also be arranged for taking documents off the bottom of a stack. The separation unit 54 is operable by a processor 55 which is connected with the bus system 50, to which the personal computer 22, serving as control system, is also connected.

The supply station 51 contains, in addition to the separation unit 54, a scanning unit 5 with a reading head assembly 25 and a processor 12. This processor 12 is likewise connected to the bus system 50, to which the personal computer 22, serving as control system, is also connected.

In the exemplary embodiment shown in FIG. 2, the documents are checked directly upon being supplied and before reaching a first station of the processing stations 2–4 and 6. This provides the advantage that any errors can be identified before the documents have been processed further. This is especially relevant in applications where the documents are printed batchwise and are transferred manually from the printer to the apparatus for assembling postal items, because this manual step involves a relatively great risk of mistakes. If, for instance, the wrong stack is placed in the supply station, in the example shown in FIG. 2 an error is reported before any document has undergone a processing step. To correct the error, it is therefore sufficient to remove the checked document and the stack of documents in the supply station 51 from the apparatus.

On the other hand, the position of the scanning unit 5 directly upstream of the inserter station 6, as shown in FIG. 1, provides the advantage that the transport along the stations 2–4 between the printer 1 and the inserter station 6 is checked. This position of the scanning unit 5 is especially advantageous if the documents are individually printed, one by one, and fed to the downstream stations 2–6, because the chance of errors is then relatively small, and when correcting an error, if necessary, one or more documents can be printed again.

It is noted that the feature that the sequence in which the processing instructions associated with particular printing instruction sets are executed by a particular station corresponds with the sequence in which those printing instruction sets are executed by the printer, does not mean that those sequences must necessarily be the same. The order in which the processing instructions are executed can, for instance, be the opposite of the order in which the associated printing instructions have been executed. This will for instance be the case when the printed documents are added to a stack from above and, after printing, are taken from above from the stack formed and are supplied to the further stations.

A particularly advantageous elaboration of the invention provides that exclusively verification data associated with the first sheet of the main document are stored. For checking the transport of the set, this is sufficient, because the first sheet of each main document constitutes the outer side of the set in question and continues to do so during the assembly of the set. In particular, the first sheet of each set nearly always contains the address of the addressee, which constitutes very suitable information for identifying a document. The set can be checked during or after being assembled by scanning the brightness pattern in the area of the address field. Also after being packaged in a window envelope, each set can be checked optionally once again, by scanning the address field through the window of the envelope. As verification data, always the same verification data can be used, also in cases of repeated scanning of a particular set.

If on the envelope an address corresponding with the address on the main document is printed, the envelope can be scanned too, in order to determine whether a set of documents is being packaged or has been packaged in the correct printed envelope.

To that end, the system shown in FIG. 2 is provided with a printer/scanning unit 56 which is connected to the inserter station 6. The printer/scanning unit 56 contains a printer part 57 with a processor 58 which is connected via the bus system 50 to the central processor and a scanning unit 61 with a reading head assembly 59 which is coupled to a processor 60, likewise connected to the central processor 9 via the bus system 50.

In operation, the envelopes are supplied to the printing unit 57, where an address is printed on them, which, for instance, corresponds with an address printed on a main document which is on its way to the inserter station. The printing instruction sets for printing each address are preferably part of the processing instructions associated with the main document in question. The printed envelopes are supplied to the inserter station where a document or a set of documents is packaged in the envelope. Finally, the envelope with the document(s) therein is discharged along the scanning unit 59. The scanning unit 59 scans the address and signals the brightness pattern obtained to the processor 60. This processor 60 processes the brightness signal into a scanning result, which is transmitted via the bus system 50 to the central processor 9, where it is compared with verification data which, on the basis of the associated sequence information, should correspond with the relevant scanning result. When too large a difference is found, a difference report signal is generated. This signal can be equal to or different from the difference report signal which is generated when, upon comparison of scanning results obtained by scanning a document, too large a difference is found.

The method and apparatus according to the invention are also useful for checking whether unique documents belonging together in pairs are properly matched. In that case, a printing pattern scanned from a document to be added is compared with a printing pattern represented or designated by the processing instructions associated with the printed main document. Over known methods of matching with verification, where parts of both documents are scanned and compared, this provides the advantage that the documents to be merged need not contain any parts that agree with each other.

For that matter, within the scope of the invention it is also possible to print and process several, successive or unsuccessive, identical documents. It is also possible that the same or at least equal processing instructions are associated with several documents. If several successive documents are identical, it may not be until the moment when a different scanning result is detected for the first time or other verification data are used as reference, that a transport error is detected. It is therefore preferred not to process unduly many mutually different documents in succession. If a large number of specimens of a particular document are to be printed and processed, it is preferred not to print and process all of them in uninterrupted succession but to print and process them in alternation with other documents. This need not have an adverse influence on the number of postal items to be prepared per unit time.

I claim:

1. A method for preparing postal items, comprising:

supplying to a printer a number of sets of printing instructions each intended for printing a document;

the printing of documents by said printer in accordance with the supplied sets of printing instructions;

supplying a number of mutually different processing instructions to a station of an apparatus for assembling postal items, which processing instructions are each associated with particular sets of said sets of printing instructions, while the order in which the processing instructions are carried out by the station corresponds with the order in which said sets of printing instructions are carried out by the printer;

supplying documents from the printer to said station;

operating the station in correspondence with the supply of a document to the station and with processing instructions associated with sequence information whose turn is next;

determining verification data, starting from the sets of printing instructions;

assigning to particular data of the verification data associated sequence information in accordance with the order in which the sets of printing instructions have been or are being executed by the printer;

storing the verification data in a memory in combination with associated sequence information;

scanning a printing of at least a number of the documents, whereby in each case a scanning result is obtained;

assigning to scanning results associated sequence information in accordance with the order in which the documents have been scanned;

comparing one of the scanning results with verification data of which the associated sequence information corresponds with the sequence information assigned to that scanning result; and generating a difference report signal if the scanning result shows more than a predetermined extent of difference from the verification data compared herewith.

2. A method according to claim 1, wherein if a scanning result shows more than a predetermined extent of difference from the verification data compared, prior to the difference report signal a printing of at least one next document is scanned, whereby at least one further scanning result is obtained, to the or each further scanning result associated sequence information is assigned in accordance with the order in which the documents have been scanned, the or each further scanning result is compared with verification data of which the associated sequence information corresponds with the sequence information assigned to that further scanning result, a first difference report signal is generated if the at least one further scanning result also shows more than a predetermined extent of difference from the verification data compared therewith, and another difference report signal is generated if the or each said further scanning result and at least one preceding scanning result shows less than a predetermined extent of difference from the verification data compared therewith.

3. A method according to claim 1, wherein if a scanning result shows more than a predetermined extent of difference from the verification data compared therewith, the scanning result is additionally compared with further verification data including verification data of which the associated sequence information corresponds with the sequence information to be assigned to the next or preceding scanning result, and a transport failure signal is generated if the scanning result shows less than a predetermined extent of difference from verification data compared therewith, associated with sequence information corresponding with sequence information to be assigned to one of the next or preceding scanning results.

4. A method according to claim 3, wherein if the scanning result show less than a predetermined extent of difference from the verification data compared therewith, associated with sequence information corresponding with sequence information to be assigned to one of the next or preceding scanning results, it is determined, starting from the sequence information associated with the verification data showing less than a particular extent of difference, how sequence information associated with next scanning results can be synchronized with sequence information associated with next verification data.

5. A method according to claim 1, wherein determining the verification data comprises processing at least a part of one of the sets of printing instructions into a pixel representation of the pattern to be printed, signals obtained during the scanning are processed into a scanning result in the form of a pixel representation of the scanned printing, and comparing the scanning results with verification data comprises comparing a pixel representation according to a scanning result with a pixel representation according to the verification data.

6. A method according to claim 1, wherein printing at least some of the documents comprises printing alphanumeric characters, determining the verification data comprises determining successions of characters according to one of the sets of printing instructions, from signals obtained during the scanning characters in scanned printing patterns are recognized, and comparing scanning results with verification data comprises comparing the succession of codes representing alphanumeric characters according to a scanning result with the succession of codes representing alphanumeric characters according to verification data.

7. A method according to claim 1, wherein printing at least some of the documents comprises printing lines or columns made up of a number of characters, determining the verification data comprises deriving from one of the sets of printing instructions a number of lines or columns intersecting a particular path over the document to be printed or printed, scanning is carried out along said path, signals obtained during the scanning are processed into a scanning result indicating numbers of lines or columns in the area of said path over the scanned document, and comparing the verification data and the scanning result comprises comparing the number of lines according to a scanning result with the number of lines according to verification data.

8. A method according to claim 7, wherein during the scanning of the documents, mean local printing densities over an interval of a length of at least a half x-height of text on the document are recorded.

9. A method according to claim 7, wherein during the scanning of the documents, mean local printing densities over an interval of a length of at least one and a half x-width of text on the document are recorded.

10. A method according claim 1, wherein a document is scanned at least twice and the scanning results obtained during the scanning of a particular document are compared with the same verification data.

11. A method according to claim 1, further comprising: placing at least one document in an envelope and scanning a portion of that document via a window of that envelope.

12. A method according to claim 1, wherein verification data associated with particular main documents, starting from printing instructions for printings in address fields of those main documents are obtained, further comprising:

printing on envelopes addresses with corresponding with addresses printed on said main documents;

placing said main documents in the printed envelopes, while the printing and transporting of the documents and the envelopes is synchronized for placing each main document in an envelope with a corresponding address printed thereon;

scanning the printed envelopes; and comparing the scanning results obtained by scanning the envelopes with such of said verification data as correspond therewith as to sequence information.

13. An apparatus for assembling postal items, comprising:

a station for processing documents;

a document supply track connected to the station for supplying documents to be processed to that station;

a control system coupled to the station, which control system is arranged for transmitting new processing instructions to the station in accordance with the supply of successive documents to the station, in such a manner that documents supplied to the station are processed by the station in accordance with the associated processing instructions;

means for synchronizing the supply of processing instructions to the station with the supply of documents to the station;

means for recording sequence information associated with verification data;

means for reading the recorded sequence information;

a scanning unit for scanning the printing of supplied documents, which scanning unit is coupled to the control system;

wherein the control system is arranged for processing signals received during the scanning into scanning results, for assigning sequence information to the scanning results, for selecting verification data associated with particular sequence information, for comparing particular scanning results of the scanning results and selected verification data of the verification data, and for generating a difference report signal depending on an observed extent of difference between said particular scanning results and said selected verification data.

14. An apparatus according to claim 13, further comprising a memory for storing verification data in combination with the associated sequence information.

15. An apparatus according to claim 13, further comprising:

a printer for printing documents coupled to the control system, means for processing data regarding the printing instructions into verification data, and a transport track which connects the printer with the station for supplying, one by one, individual documents printed by the printer, from the printer to the station.

16. An apparatus according to claim 13, further comprising: a printer for printing envelopes and a further scanning unit for scanning printed envelopes, wherein the control system is further arranged for processing signals received during the scanning of the envelopes into scanning results, for assigning sequence information to the scanning results obtained through the scanning of envelopes, for the renewed selection of verification data associated with particular sequence information, for comparing particular scanning results of the scanning results and selected verification data of the verification data, and for generating a difference report signal, depending on an observed extent of difference between said particular scanning results and said selected verification data.

* * * * *